United States Patent [19]

Lemaire

[11] Patent Number: 4,528,796

[45] Date of Patent: Jul. 16, 1985

[54] APPARATUS FOR AUTOMATIC FILLING AND CLOSING OF CONTAINERS

[75] Inventor: Didier Lemaire, Cherizy Vernouillet, France

[73] Assignee: E. P. Remy Et Cie, France

[21] Appl. No.: 490,587

[22] Filed: May 2, 1983

[30] Foreign Application Priority Data

Feb. 8, 1983 [FR] France ..... 83 01968

[51] Int. Cl.[3] ..... B65B 3/04; B67B 1/00; B67B 3/00; B67B 3/20

[52] U.S. Cl. ..... 53/268; 53/276; 53/299; 53/307

[58] Field of Search ..... 53/266 R, 268, 281, 53/282, 283, 299, 307, 276, 467, 471, 277, 278

[56] References Cited

U.S. PATENT DOCUMENTS

| | | | |
|---|---|---|---|
| 959,577 | 5/1910 | McEwan | 53/276 |
| 3,382,644 | 5/1968 | Vogt | 53/266 |
| 3,712,023 | 1/1973 | Bryan, Jr. et al. | 53/282 |
| 3,965,656 | 6/1976 | Gerben | 53/282 |

FOREIGN PATENT DOCUMENTS

| | | |
|---|---|---|
| 0012429 | 6/1980 | European Pat. Off. . |
| 1509588 | 1/1968 | France . |
| 967803 | 8/1964 | United Kingdom . |

*Primary Examiner*—Robert L. Spruill
*Assistant Examiner*—Richard M. Mudd
*Attorney, Agent, or Firm*—Steinberg & Raskin

[57] ABSTRACT

This invention relates to an arrangement for continuous automatic filling and closing of successive encased groups of containers wherein use is made of a dispensing unit connected to a closing unit which is pivotally rotated so as to be substituted for the dispensing unit after the filling of the group of containers.

7 Claims, 9 Drawing Figures

1
2
3
4
5
5a
6
7
7a
8
9
10
11
12
13
13a
13b
13c
13d
13e
14
15
16
17
18
19
20
21
22
23
24
24a
25
26
27
28
29
30
31
31a
32
33
34
35
36

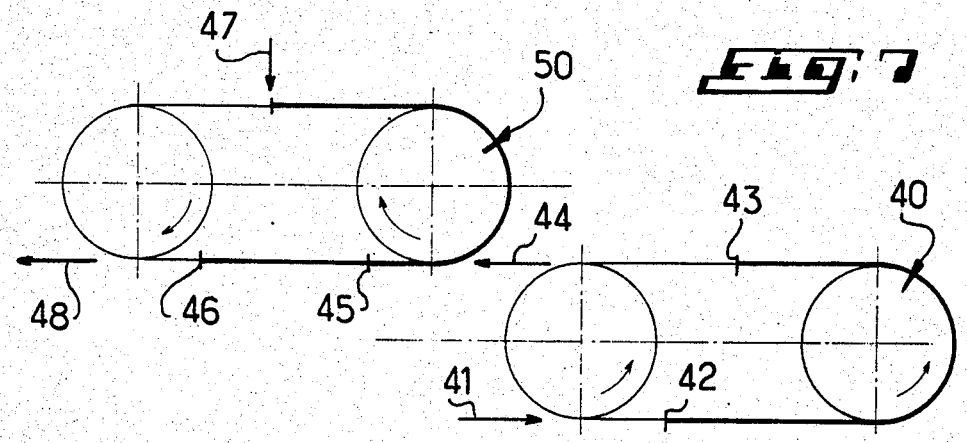
Fig. 7
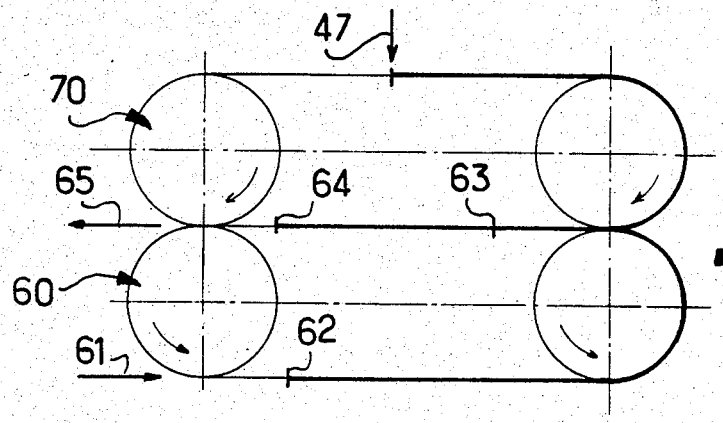
Fig. 8
Fig. 9
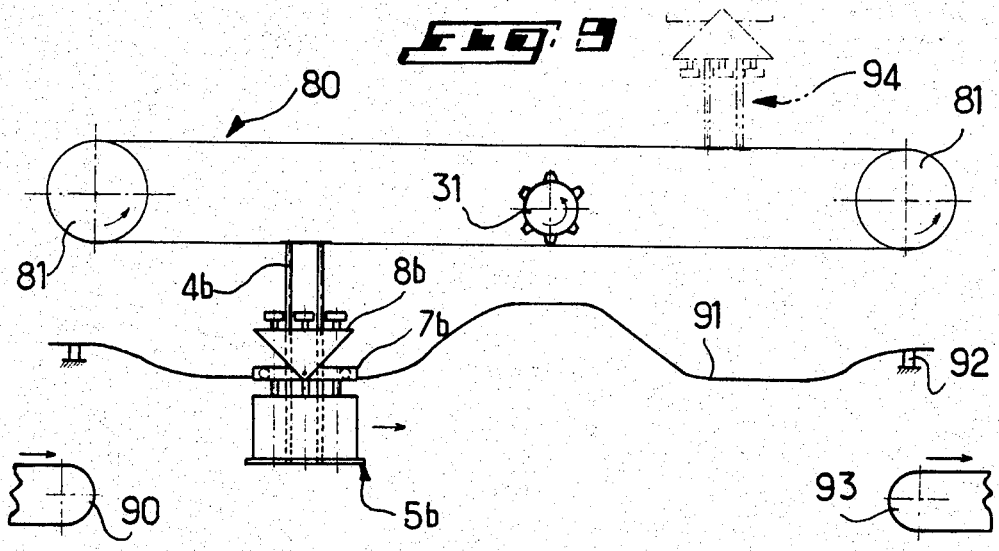

APPARATUS FOR AUTOMATIC FILLING AND CLOSING OF CONTAINERS

BACKGROUND OF THE INVENTION

The present invention has essentially for a subject matter a process of automatic and continuous filling and closing of containers such as for example bottles, phials or the like.

It is also directed to a machine for carrying out said process.

There are already known machines for filling containers with any liquid, as well as machines for subsequently closing said containers. But, these two operations are generally effected by separate assemblies or machines. Moreover, other machines must be used when it is desired to fill and close a group of containers. Thus, if it is desired for example to fill and close a group of encased bottles, use must necessarily and successively be made of a machine for encasing the bottles, a machine or a conveyor for rearranging said bottles into a row, a filling machine, a closing machine, a distributor for rearranging into several adjacent lines or rows the previously closed bottles, and, lastly, a machine for encasing the groups of closed bottles.

Otherwise stated, there must be available a stock of machines which requires much floor space, is quite expensive and, on the whole, of low efficiency since the filling and closing rate is not high owing to the number of operations performed by separate machines.

SUMMARY OF THE INVENTION

The present invention has for a purpose to remedy the above disadvantages by providing a process and a single machine for continuous filling and closing of a group of encased containers, said process and machine ensuring a particularly high filling and closing rate never hitherto attained.

To this end, the invention has for a subject matter a process of automatic filling and closing of containers, such as for example bottles, phials or the like intended to be filled with any liquid and thereafter closed, characterized in that in course of continuous conveyance of a group of preferably encased containers, a dispensing unit capable of filling simultaneously the containers of the said group is caused to move continuously straight above the said group, then a unit for simultaneous closing of the containers of the group is substituted for the dispensing unit, and the group of closed containers is automatically discharged and replaced by another group of containers to be filled and closed according to the above continuous succession of operations.

According to another characterizing feature of the process, the closing unit is automatically supplied with plugs, caps or like stoppers before being rotated to be substituted for the dispensing unit after the filling of the group of containers.

It will also be added here that, after the filling, the dispensing unit is lifted and/or the group of filled bottles is lowered to allow said substitution and closing.

The invention is also directed to a machine for continuous automatic filling and closing of successive groups of containers, such as for example bottles, phials or the like, of the type using at least one endless chain or like conveyor for the transfer of said groups of containers, preferably encased, said machine being essentially characterized in that movable dispensing units each arranged above a group of containers are associated with said conveyor, or first conveyor, whereas movable closing units adapted to be substituted for the dispensing units are associated with said first conveyor above each group of containers or with a second conveyor driven in synchronism with said first conveyor.

It can thus be already understood that the continuous automatic filling and closing of a group of encased bottles can be performed by means of a single conveyor or, at most, of two conveyors.

According to another characterizing feature of the machine, said closing units are rotatably or pivotally mounted on said first or second conveyor.

In case the dispensing and closing units are associated with a single conveyor consisting of said first conveyor, each closing unit is pivotally mounted on each dispensing unit.

According to still another characterizing feature of the invention, at least the aforesaid first conveyor being constituted by a revolving conveyor arrangement comprising for example a pair of endless chains or the like arranged horizontally and provided therebetween with a plurality or transverse bars, a plate for supporting a group of containers and a dispensing unit with its associated, pivotally mounted closing unit are slidingly mounted on each bar or group of bars.

It will also be specified here that the said revolving conveyor arrangement is equipped with at least one closed-loop cam for controlling the relative position of each dispensing unit with respect to each supporting plate.

According to still another characterizing feature of the invention, each said closing unit is provided with a plurality of heads for screwing or snapping in plugs, caps or like stoppers conveyed to the said heads by a drum provided with fingers and with which is associated at least one shoot conveying the stoppers onto the said fingers.

Furthermore, the rotation or pivoting of the closing unit is preferably performed by a double-acting actuating cylinder.

BRIEF DESCRIPTION OF THE DRAWINGS

Other characterizing features and advantages of the invention will appear more clearly from the following detailed description made with reference to the appended drawings given solely by way of example and wherein:

FIGS. 7 and 8 are top views illustrating diagrammatically two modified forms of embodiment of the machine, respectively;

FIG. 9 is a diagrammatic elevational view illustrating a third form of embodiment of the machine.

DETAILED DESCRIPTION OF THE PREFERRED EMBODIMENTS

Figure 1:
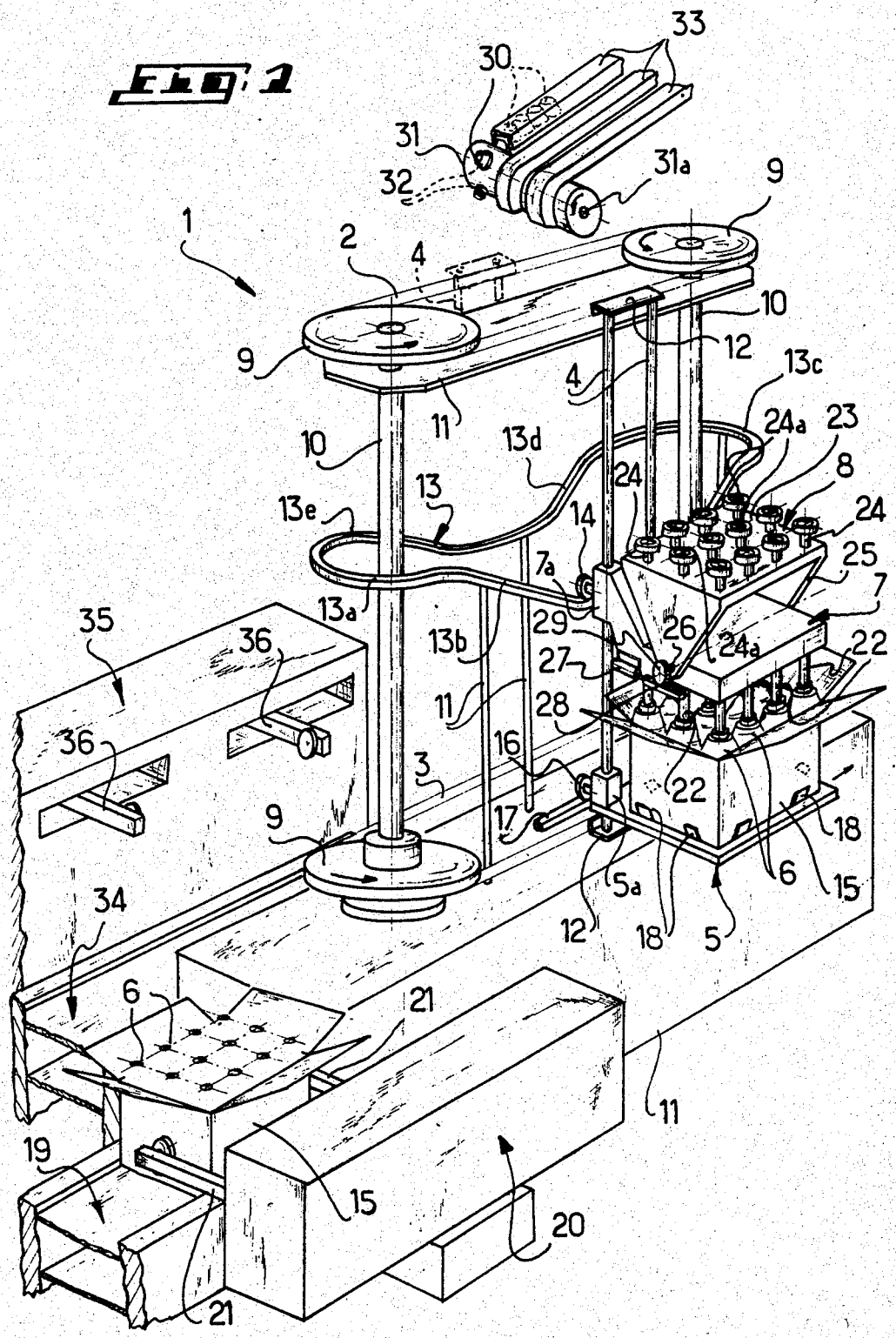
FIG. 1 is a diagrammatic perspective view of a filling and closing machine according to the invention.

According to one example of embodiment, and referring more particularly to FIG. 1, a continuous automatic filling and closing machine according to the present invention comprises essentially a revolving conveyor arrangement 1 consisting of a pair of endless chains 2,3 arranged in the horizontal plane and provided with transverse bars 4 on which are slidingly mounted a plate 5 for supporting a group of containers or bottles 6, and a dispensing unit 7 with which is associated a closing unit 8.

More precisely, and as clearly seen in FIG. 1, the endless chains 2 and 3 are mounted round two pairs of gear wheels 9 solid in rotation with a shaft 10 mounted in the frame 11 of the machine, said chains 2 and 3 carrying members shown diagrammatically at 12 and to which are attached the ends of the bars 4 on which are mounted vertically slidingly the supporting plate 5 and the dispensing and closing unit 7 and 8, as shown at 5*a* and 7*a*.

According to the form of embodiment illustrated, the plate 5 and the unit 7,8 are slidingly mounted on a pair of bars 4, but they may as well, without departing from the scope of the invention, be slidingly mounted on a single bar or on more than two bars. Likewise, for the sake of clarity, there is shown only a single supporting plate 5 with its associated dispensing and closing unit 7 and 8, it being understood that the revolving conveyor arrangement 1 comprises a plurality of means such as 5, 7 and 8, each of these means being slidingly mounted on the successive pairs of bars 4.

The revolving conveyor arrangement 1 is equipped with a closed-loop cam 13 on which are constantly applied rollers 14 or the like jointly movable with the unit 7 and capable, by rolling on the said cam as the chains 2 and 3 are driven, of varying the relative position of each dispensing unit 7 with respect to the plate 5 supporting the group of containers 6 encased previously, as seen at 15. Each plate 5 supporting the cases 15 with the containers 6 may also be provided with rollers 16 co-operating with another cam shown diagrammatically at 17 to also allow, if appropriate, the relative vertical displacement of the said plate with respect to the dispensing and closing unit 7,8.

At 18 are shown lugs or the like allowing the cases 15 to be retained and centered on the plate 5, said cases being conveyed onto the said plate for example by means of a conveyor 19 with which is associated a gripping device 20 with movable grips or jaws 21 for seizing the cases 15 and placing them on each plate 5. In this respect, however, it will be noted that use can be made, without departing from the scope of the invention, of any other suitable means for positioning the cases 15 on the plate 5, when the latter is available.

Each dispensing unit 7 is provided at its lower portion with a plurality of spouts or the like 22 for filling the containers 6. Each dispensing unit 7 is of course connected to a source of fluid with which it is desired to fill the container 6 and, once the said containers are filled up simultaneously, the fluid reaching each dispensing unit 7 is cut off automatically, e.g. by merely lifting the dispensing unit 7, i.e., when the spouts 22 are withdrawn from the necks of the bottles 6.

Each closing unit 8 comprises essentially a portion 23 for supporting a plurality of heads 24 for screwing or snapping in or on plugs, caps or like stoppers or closures shown at 30.

The support 23 for the heads 24 is pivotally mounted on the dispensing unit 7 through the medium of, for example, two flanges 25 whose ends are pivotally connected to each side of the dispensing unit 7, as shown at 26. Thus, as is readily understood, the closing unit 8 may rotate round the axis pin 26 so that the support 23 for the screwing heads 24 can be moved to a position below the pouring spouts 22 and thus be substituted for the dispensing unit 7. The pivoting of the closing unit 8 is ensured for example by means of a cylinder 27 actuating a toothed rack 28 meshing with a pinion 29 mounted on the flanges 25.

The heads 24 of the dispensing unit 8 are each provided with a receptacle or the like 24*a* which, prior to rotation, can receive plugs or like stoppers 30 conveyed to the receptacle 24*a* of the heads 24 by a drum 31 carrying several rows of fingers 32. Chutes 33 arranged perpendicularly to the axis 31*a* of the drum 31 convey the plugs 30 onto the fingers 32 which are thus capped with the said plugs and, as the drum 31 rotates, can snap or drive the plugs into the receptacles 24*a* of the heads 24. It will be noted, in this respect, that there may be provided any suitable system allowing snapping the plugs 30 onto the screwing heads carried by the element 8.

There is shown at 34 a belt for discharging the cases 15 containing the filled and closed containers, and at 35, a gripping system of any suitable type, e.g. identical with the system 20, and which, by means of movable grips 36, extracts the cases 15 from the plate 5 and places them on the belt 34. However, the use of any other suitable system may be contemplated for discharging the cases with the closed containers.

There will now be described in detail the operation of the machine just described, referring more especially to FIGS. 2 to 6.

Figures 2, 3, 4, 5, 6:
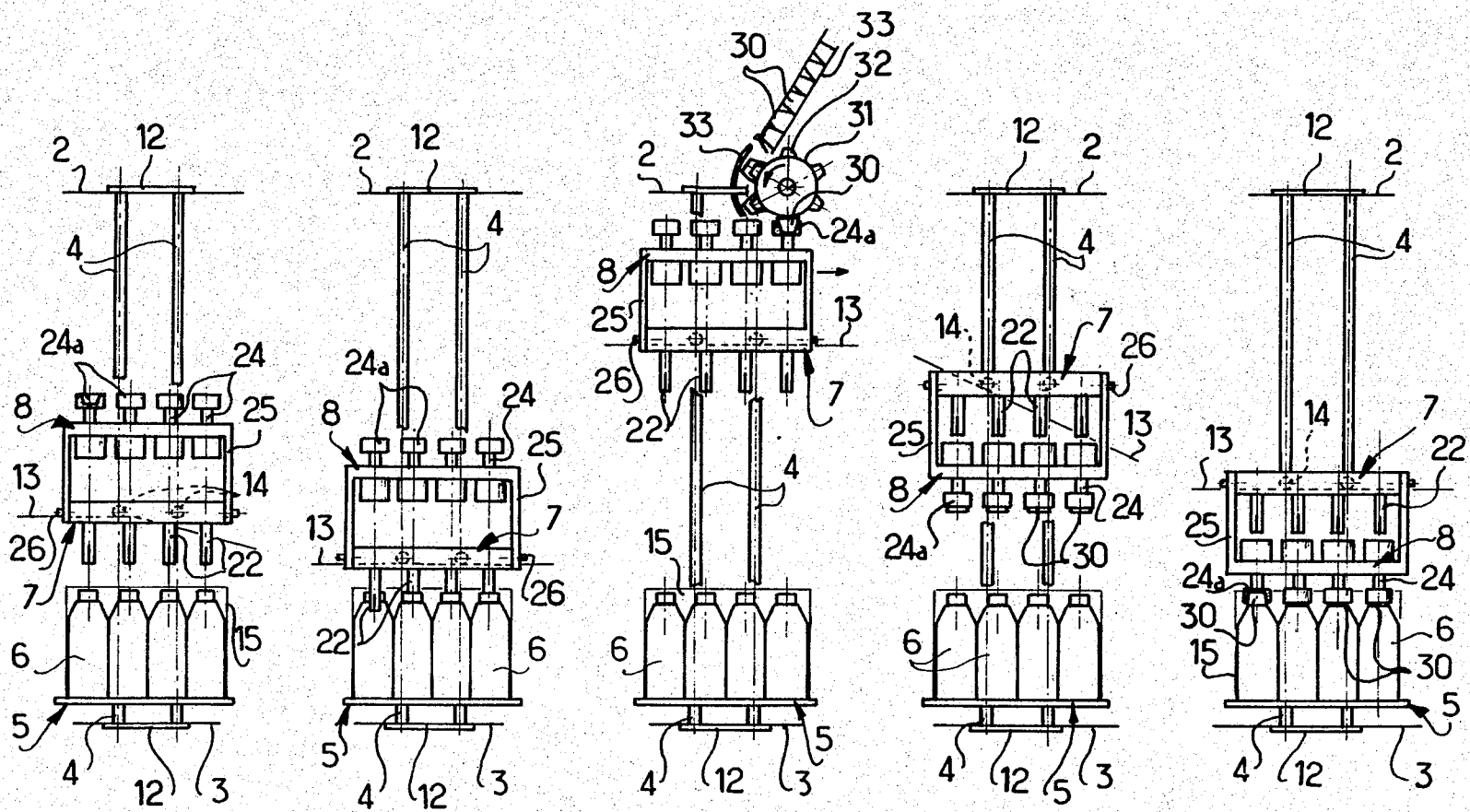
FIGS. 2 to 6 are diagrammatic elevational views illustrating the successive stages of operation of the machine, and more particularly the relative movements of the dispensing and closing units.

Starting from the position shown in FIG. 2 and wherein a case 15 of empty and open containers has been placed on the plate 5, it is seen that the loading of the plate presents no difficulty since the dispensing unit 7 with its associated and non-rotated closing unit 8 is in its higher position, i.e., the rollers 14 of the dispensing unit 7 are located on the upper portion 13*a* of the cam 13.

As the revolving conveyor unit 1 rotates continuously, the rollers 14 move down onto the inclined portion 13*b* of the cam 13, thus lowering the spouts 22 of the dispensing unit 7 into the necks of the containers 6 to ensure the filling of the latter, as seen clearly in FIG. 3.

The plate 5 and the dispensing element 7 continue to rotate and are raised on reaching the portion 13*c* of the cam 13, thus, the spouts 22 leaving the containers 6 automatically cut off the supply of the dispensing element 7 with liquid and the closing unit 8 moves to a position straight below the supply of stoppers 30 by the drum 31. This is seen in FIG. 4 where the stoppers 30 are placed successively in the receptacles 24*a* of the advancing screwing heads 24.

Immediately after this operation, and as seen in FIG. 5, the closing unit 8 is caused to swivel by the actuating cylinder 27 so as to be susbstituted for the dispensing unit 7. During this, the dispensing unit 7 rolls on the inclined portion 13*d* of the cam 13 and moves down towards the encased containers 6 until, as seen in FIG. 6, the screwing heads 24 provided with stoppers 30 cap the openings of the containers 6. The screwing heads 24 are then actuated to screw or snap in the stoppers 30.

After this operation, the dispensing element 7 is moved upward by the portion 13*e* of the cam 13 and the closing element 8 frees the bottles, so that the case containing them can be discharged by the belt 34. The closing element 8 is swivelled upwardly by the actuating cylinder 27 and the dispensing element associated with the said closing element is in its higher position, so that the position is again the one shown in FIG. 2, i.e., the position where a further case 15 is loaded with bottles 6 to be filled and closed according to the above continuous succession of operations.

It is therefore understood from all the foregoing that a single revolving conveyor arrangement 1 allows performing automatically and continuously the operations of filling and closing of a group of encased bottles.

In compliance with the invention, and according to another form of embodiment illustrated in FIG. 7, the above succession of operations may be performed continuously by means of two conveyors or revolving conveyor arrangements, i.e., a revolving conveyor arrangement 40 comprising supporting plates 5 and, straight above each plate a dispensing unit 7, and a conveyor 50 comprising a plurality of swivelling or rotating closing elements 8, both of which revolving conveyor arrangements rotate according to the arrows of FIG. 7 and are synchronized.

Thus, the cases 15 with the empty and open containers are supplied at 41 onto the supporting plates 5 of the conveyor 40, the filling of the containers takes place between the points 42 and 43 where the dispensing unit raises as explained previously, then the filled containers are transferred by a belt 44 to the closing conveyor arrangement 50, the closing taking place between the points 45 and 46, it being understood that the closing element will have been previously fitted with stoppers, as seen at 47, and swivelled, as explained previously, before reaching point 45 so that the closing operation can take place. The cases with the filled and closed containers are discharged at 48.

According to the form of embodiment illustrated in FIG. 8, the cases with the empty and open containers are transferred by a belt 61 to a conveyor 60 for supporting the cases and filling the containers by means of dispensing elements such as 7. With this conveyor 60 is associated a conveyor 70 carrying closing units, said conveyor 70 being shifted in the vertical plane with respect to the conveyer 60, thus, as is understood from the arrows of FIG. 8, the filling takes place between the points 62 and 63, and, at the point 63, the dispensing elements are lifted, so that the closing units are substituted for the dispensing units 7 of the conveyor 60 to perform the closing or capping of the containers between point 63 and the point 64, whereafter the cases with the closed containers are discharged at 65.

Lastly, FIG. 9 illustrates a machine comprising a revolving conveyor arrangement with horizontal axes 81 and supporting by means of bars **4*b* the dispensing units 7*b* with which are pivotally associated closing units 8*b*. A belt 90 allows loading the cases with empty and open containers onto the plates 5*b* connected to the rods 4*b*. The relative movements of the dispensing units 7*b* with respect to the plates 5*b* are performed by a cam 91 connected to the frame 92 of the machine. Thus, the succession of filling and closing operations takes place exactly as described in connection with FIGS. 1 to 6, except that use is made in this case of a cam path 91 which is unidirectional so that the filled and closed bottles can be discharged by a belt 93 arranged below the exit end of the camp path 91. It will be noted here that, once the filling and closing cycle is completed, the units 7*b*, 8*b* as well as the plates 5*b* are again in the inoperative position on the upper side of the conveyor 80, as shown at 94**.

There is therefore obtained, according to the invention, a machine for continuous automatic filling and closing groups of successive containers, said machine allowing especially high filling and closing rates to be obtained and applying to the filling and closing of containers of any shape and apt to contain any liquids.

Of course, the invention is by no means limited to the forms of embodiment described and illustrated which have been given by way of example only. The invention therefore comprises all technical equivalents to the means described as well as their combinations should the latter be carried out according to its gist.

What is claimed is:

1. A machine for continuously and automatically filling and closing successive groups of individual containers, said machine comprising at least one endless chain conveyor adapted to transport the groups of containers, movable dispensing units associated with said conveyor, each unit being arranged about a respective group of containers, and movable closing units pivotally mounted on said respective dispensing units and adapted to substitute for said dispensing units below the same and above the group of containers, after the containers are filled by said dispensing units.

2. A machine according to claim 1, wherein said endless chain conveyor comprises a pair of endless chains arranged substantially horizontally, and a plurality of vertical bars transversely mounted on said chains, said dispensing units and closing units associated therewith being slidingly mounted on said bars.

3. A machine according to claim 2, which further comprises plate means for supporting a group of containers, said plate means being slidingly mounted on said bars.

4. A machine according to claim 3, wherein said plate means comprises a plurality of supporting plates, each plate being associated with a respective group of containers, and said endless chain conveyor is provided with at least one closed-loop cam for the control of the relative position of each dispensing unit and its associated closing unit with respect to each respective supporting plate.

5. A machine according to claim 1, wherein said closing units each comprise a plurality of heads for snapping stoppers onto the containers, and said machine additionally comprises a drum having fingers thereon for driving the stoppers into said heads.

6. A machine according to claim 1, which further comprises a double-acting actuating cylinder for controlling the pivoting of said closing unit with respect to said dispensing unit.

7. A machine according to claim 3, which further comprises a second conveyor having a gripping device associated therewith for seizing the groups of containers and placing the same onto said plate means.

* * * * *